United States Patent [19]

Santos, Jr. et al.

[11] 3,969,169

[45] July 13, 1976

[54] METHOD OF MAKING PAPER-INSULATED ELECTRICAL CONDUCTOR

[75] Inventors: Adrian Y. Santos, Jr., Yonkers; Charles Feder, Riverdale, both of N.Y.

[73] Assignee: Phelps Dodge Industries, Inc., New York, N.Y.

[22] Filed: Apr. 11, 1975

[21] Appl. No.: 567,382

Related U.S. Application Data

[60] Continuation of Ser. No. 362,102, May 21, 1973, abandoned, which is a division of Ser. No. 256,896, May 25, 1972, Pat. No. 3,781,462.

[52] U.S. Cl. ..... 156/56; 156/187; 156/192; 156/309; 156/313

[51] Int. Cl.[2] ..... H01B 13/06; H01B 13/16; H01B 13/26

[58] Field of Search ..... 156/51, 52, 53, 54, 156/56, 187, 192, 195, 201, 309, 313; 174/120 R, 120 C, 120 SR, 120 FP, 121 B, 121 R, 113 R

[56] References Cited

UNITED STATES PATENTS

| | | | |
|---|---|---|---|
| 351,191 | 10/1886 | McCracken | 174/121 R |
| 806,348 | 12/1905 | Kitsee | 156/52 |
| 2,164,168 | 6/1939 | Wertzheiser et al. | 174/120 C |
| 3,112,357 | 11/1963 | Imhof | 156/187 |
| 3,250,850 | 5/1966 | Felix | 156/51 |
| 3,621,119 | 11/1971 | Sugiyama et al. | 174/113 R |
| 3,736,178 | 5/1973 | Sadler et al. | 174/121 B |
| 3,763,554 | 10/1973 | Early | 156/51 |

*Primary Examiner*—William A. Powell
*Assistant Examiner*—Basil J. Lewris
*Attorney, Agent, or Firm*—Cyrus S. Hapgood

[57] ABSTRACT

Interposed between the conductor and the helical or longitudinal wrapping of paper insulation is a layer of selfsetting, heat sealable emulsion having adhesive properties and which is inert, water soluble and free of metal. The emulsion is absorbed by the innermost lay of the paper and causes it to adhere to the next outer paper lay, while the outer portion of the paper which is not exposed to the saturated portion remains loosely formed around the conductor. Upon drying of the paper insulation, the solid portion of the emulsion remains as a film on the periphery of the conductor and the innermost surface of the paper.

3 Claims, 2 Drawing Figures

METHOD OF MAKING PAPER-INSULATED ELECTRICAL CONDUCTOR

Figure 1:
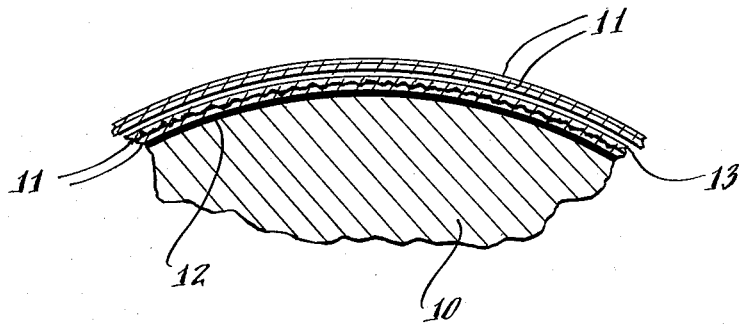

The present application is a continuation of our patent application Ser. No. 362,102, filed May 21, 1973, now abandoned, which is a division of our patent application Ser. No. 256,896 filed May 25, 1972, now U.S. Pat. No. 3,781,462 granted Dec. 25, 1973.

This invention relates to electrical conductors of the paper-insulated type and more particularly to an improved method of making such a conductor.

In fabricating the new insulated conductor, the paper is wrapped in a plurality of lays around the conductor either helically or longitudinally in the usual manner, to form an insulating sheath. However, before application of the paper, a layer of emulsion having certain properties is applied so that it will be interposed between the bare conductor and the paper. This emulsion is self-setting, heat sealable, water soluble, inert and non-metal-bearing; and it has adhesive properties but will not cause oxidation of the copper or other metal of the conductor and will not impair the integrity of the paper. Examples of such an emulsion are Du Pont's Elvacet Series of Polyvinyl/Acetate or Acetate/Ethylene emulsions.

The paper may be of the type conventionally used for insulating electrical conductors. Examples of such paper are F-101, F-102, F-103, F-104 and F-105 described in Material Specification 57746-P of Western Electric Company.

The emulsion can be applied by passing the copper or other conductor through a bath of the emulsion, from which it is carried by the conductor to the location where the paper insulation is wrapped helically or longitudinally around the conductor. Alternatively, the emulsion can be applied by spraying it on the paper during the wrapping operation, for example, during the first wrap of the paper, or during the twinning operation. In any case, the emulsion is absorbed by the innermost layer of the paper and causes it to adhere to the next outer layer, forming essentially a paper tube around the conductor. After the usual step of drying the paper core wrapped around the conductor, to extract moisture therefrom, the remaining solids in the emulsion form a film on the innermost face of the paper wrapping and on the outer surface of the conductor. The insulating paper is thus reinforced by the film and the aforementioned adhesion between the inner lays of the paper.

This paper reinforcing system has several advantages. It eliminates "shiners" caused by paper unraveling and therefore promotes efficiency in production. It reduces the number of shorted pairs during field work (splices or extensions). It results in the final insulation effect of the treated paper being more uniform as compared to conventional paper insulation. It permits the application of B conductors more easily, since push-back of the insulation is eliminated. Also, paper insulation in accordance with the invention has a lower moisture absorption rate than conventional paper insulation.

Figure 2:
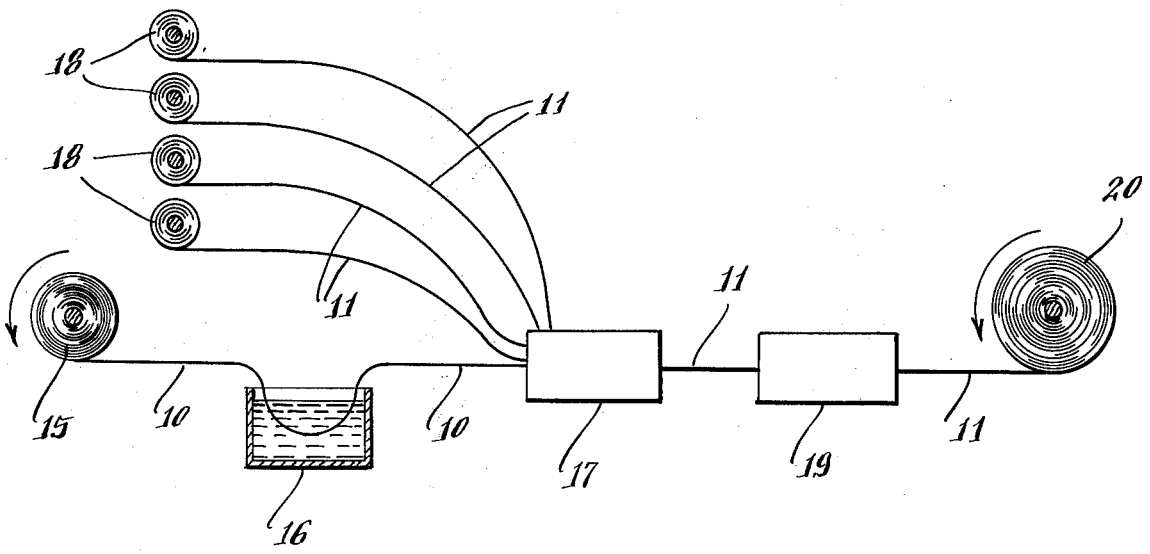

For a better understanding of the invention, reference may be made to the accompanying drawing, in which:

FIG. 1 is an enlarged cross-sectional view of part of an insulated conductor made according to the invention, and FIG. 2 is a schematic view of an apparatus for carrying out one form of the new method.

Referring to FIG. 1, the electrical conductor is shown at 10 and is preferably made of copper. A sheath of paper insulation 11 is formed around the conductor in the conventional manner by wrapping a plurality of lays of the paper helically or longitudinally around the conductor. Between the peripheral surface of conductor 10 and the innermost surface of the paper insulating sheath 11 is a reinforcing film 12 which results from drying of the emulsion previously described.

The effect of the emulsion from which the reinforcing layer 12 is derived can best be explained by referring to the example of the new method illustrated in FIG. 2. As there shown, the bare conductor 10 is drawn from a supply reel 15 through a bath of the emulsion in a container 16. From the container 16, the conductor carries a coating of the emulsion to the conventional machine 17 for wrapping the paper insulation around the conductor. As illustrated, the paper 11 is drawn into the wrapping machine 17 in a plurality of tapes from supply reels 18, four of these reels and paper tapes being shown by way of example. In the wrapping machine 17, the paper tapes 11 are wound helically or longitudinally around the conductor 10 in a plurality of lays, as shown in FIG. 1.

During the wrapping operation at 17, the emulsion coated on the periphery of the conductor 10 is absorbed by the innermost or adjacent lay of the paper and causes this portion of the paper to adhere to the next outer paper lay. In other words, the emulsion forms an adhesive binding the innermost lay of the paper 11 to the next outer lay of the paper, as indicated at 13 in FIG. 1. As a result, these two paper lays and the adhesive 13 with which they are impregnated form essentially a paper tube around the conductor, but the remaining outer portion of the paper which is not exposed to the conductor or to the saturated portion of the paper will remain loosely formed around the conductor.

From the wrapping machine 17, the conductor and the paper insulating sheath 11 are drawn through a conventional dryer 19 to a take-up reel 20. The dryer 19 extracts moisture from the paper insulation, whereby the solids of the emulsion will remain on the innermost surface of the paper sheath as a helical or longitudinal film 12 (FIG. 1).

The practice of the present invention, therefore, results essentially in a paper and film insulating system for the electrical conductor which improves the electrical characteristics and also the manufacturing procedure. Also, it reduces the moisture absorption rate of the insulated conductor or cable as compared to those having standard paper insulation. Moreover, the emulsion, as previously indicated, has characteristics such that it does not alter or tend to degrade the insulating paper 11 and will not cause oxidation of the copper conductor.

Although emulsions of the "Elvacet Series" sold by Du Pont have been referred to heretofore as suitable for carrying out the present invention, it will be understood that other emulsions having the characteristics previously described can be used as well. Also, the emulsion can be applied by spraying it on the paper, as previously mentioned, instead of coating it directly on the conductor; and, of course, the drying operation can be effected otherwise than as shown at 19 in FIG. 1.

As previously described and as shown in FIG. 1, only the two innermost paper lays are bonded together (as shown at 13), and the remaining outer portion of the paper forms at least one outer lay which is not exposed to the adhesive and therefore is free of adherence to the next inner lay, whereby this outer lay remains loosely formed around the conductor.

We claim:

1. In the manufacture of paper-insulated electrical conductor by wrapping the paper around the conductor in at least three lays to form an insulating sheath and subjecting the sheathed conductor to a drying operation to extract moisture from the paper, the improvement which comprises saturating the innermost paper lay with an emulsion which contacts the next outer lay prior to the drying operation but leaving at least one outer paper lay unexposed to the emulsion, said emulsion being inert except that it is self-setting and being non-metal-bearing and having adhesive properties, whereby said innermost lay is adhered to the next outer lay and a reinforcing film of the emulsion solids, remaining after the drying operation, is formed between the peripheral surface of the conductor and the innermost surface of the insulating sheath, and whereby said outer lay unexposed to the emulsion is free of adherence to the next inner lay and thus remains loosely formed around the conductor.

2. The improvement according to claim 1, in which said emulsion is applied by coating it on the electrical conductor before wrapping the paper around the conductor.

3. The improvement according to claim 1, in which the emulsion is applied by spraying it on the paper during the wrapping operation.

* * * * *